US006585333B1

(12) United States Patent
Wang

(10) Patent No.: US 6,585,333 B1
(45) Date of Patent: Jul. 1, 2003

(54) COMBINATION WARDROBE WITH A REPLACEABLE DOOR STRUCTURE

(76) Inventor: Wen-Tsan Wang, PO Box 82-144, Taipei (TW)

( * ) Notice: Subject to any disclaimer, the term of this patent is extended or adjusted under 35 U.S.C. 154(b) by 0 days.

(21) Appl. No.: 10/052,750

(22) Filed: Jan. 23, 2002

(51) Int. Cl.[7] ..... E04H 1/12; A45C 5/12

(52) U.S. Cl. ..... 312/3; 312/6; 312/297; 190/13 B; 206/278

(58) Field of Search ..... 190/13 B, 13 R; 206/278; 312/4–6, 3; 160/123, 350; 135/117

(56) References Cited

U.S. PATENT DOCUMENTS

| | | | | | |
|---|---|---|---|---|---|
| 131,313 | A | * | 9/1872 | Timby | 312/5 |
| 351,860 | A | * | 11/1886 | Glidden | 190/13 B X |
| 516,292 | A | * | 5/1894 | Barry | 312/5 |
| 1,141,468 | A | * | 6/1915 | Lawton | 312/6 |
| 1,151,491 | A | * | 8/1915 | MacDaniel | 312/6 |
| 1,203,052 | A | * | 10/1916 | Ronda | 312/5 |
| 1,385,555 | A | * | 7/1921 | Keegan | 312/6 |
| 1,569,406 | A | * | 1/1926 | Sonntag | 312/5 |
| 1,571,366 | A | * | 2/1926 | Bender | 312/6 |
| 1,670,026 | A | * | 5/1928 | De Lano | 312/6 |
| 1,674,567 | A | * | 6/1928 | Provost | 312/6 |
| 4,741,167 | A | * | 5/1988 | Wigley | 312/6 X |
| 5,524,689 | A | * | 6/1996 | Clark | 160/124 |
| 6,041,454 | A | * | 3/2000 | Summerford | 4/558 |

* cited by examiner

*Primary Examiner*—Sue A. Weaver
(74) *Attorney, Agent, or Firm*—Leong C. Lei

(57) ABSTRACT

A combination wardrobe is constructed to include a wardrobe body and a double-panel door structure controlled to close/open a front opening of the wardrobe body, the double-panel door structure having a hanging rod transversely suspended from the wardrobe body above the front opening, two flexible door panels respectively hung on the hanging rod by top loops thereof and horizontally moved relative to each other to close/open the front opening, each flexible door panel having a plurality of weights arranged along the respective bottom side for keeping the respective flexible door panel in shape when extended out, and hook and loop materials adapted to secure one lateral side of each door panel to the wardrobe body.

1 Claim, 4 Drawing Sheets

COMBINATION WARDROBE WITH A REPLACEABLE DOOR STRUCTURE

BACKGROUND OF THE INVENTION

1. Field of the Invention

The present invention relates to a wardrobe for holding clothes and. more particularly, to a combination wardrobe provided with a replaceable door structure.

2. Description of the Related Art

Conventional wardrobes are commonly made of wooden material. There are portable wardrobes comprised of a metal wardrobe frame and a covering of plastic sheet material covering the metal wardrobe frame. These portable wardrobes commonly use a zipper fastener for operation by hand to close/open the front door. However, because the two opposite door panels of the covering of plastic sheet material have a respective bottom side coupled to the zip fastener, the front door is not fully opened when unfastened the zipper fastener. In order to eliminate this problem, a sliding door structure may be used. However, a sliding door structure for wardrobe is expensive to manufacture. Furthermore, when installed in a wardrobe, the sliding door is not detachable for a replacement.

SUMMARY OF THE INVENTION

The present invention has been accomplished under the circumstances in view. It is one object of the present invention to provide a combination wardrobe, which is equipped with a detachable door structure so that the user can change the design of the door panels easily as desired. It is another object of the present invention to provide a combination wardrobe, which is equipped with a detachable door structure that can easily be controlled to fully open the front opening of the wardrobe body. To achieve these and other objects of the present invention, the combination wardrobe comprises a wardrobe body having a front opening, and a double-panel door structure controlled to close/open the front opening of the wardrobe body. The double-panel door structure comprises a hanging rod transversely suspended from the wardrobe frame of the wardrobe body above the front opening, two flexible door panels respectively hung on the hanging rod by top loops thereof and horizontally moved relative to each other to close/open the front opening, each flexible door panel having a plurality of weights arranged alone the respective bottom side for keeping the respective flexible door panel in shape when extended out to close the front opening of the wardrobe body, and hook and loop materials adapted to secure one lateral side of each door panel to the wardrobe body.

DETAILED DESCRIPTION OF THE PREFERRED EMBODIMENT

Figure 1:
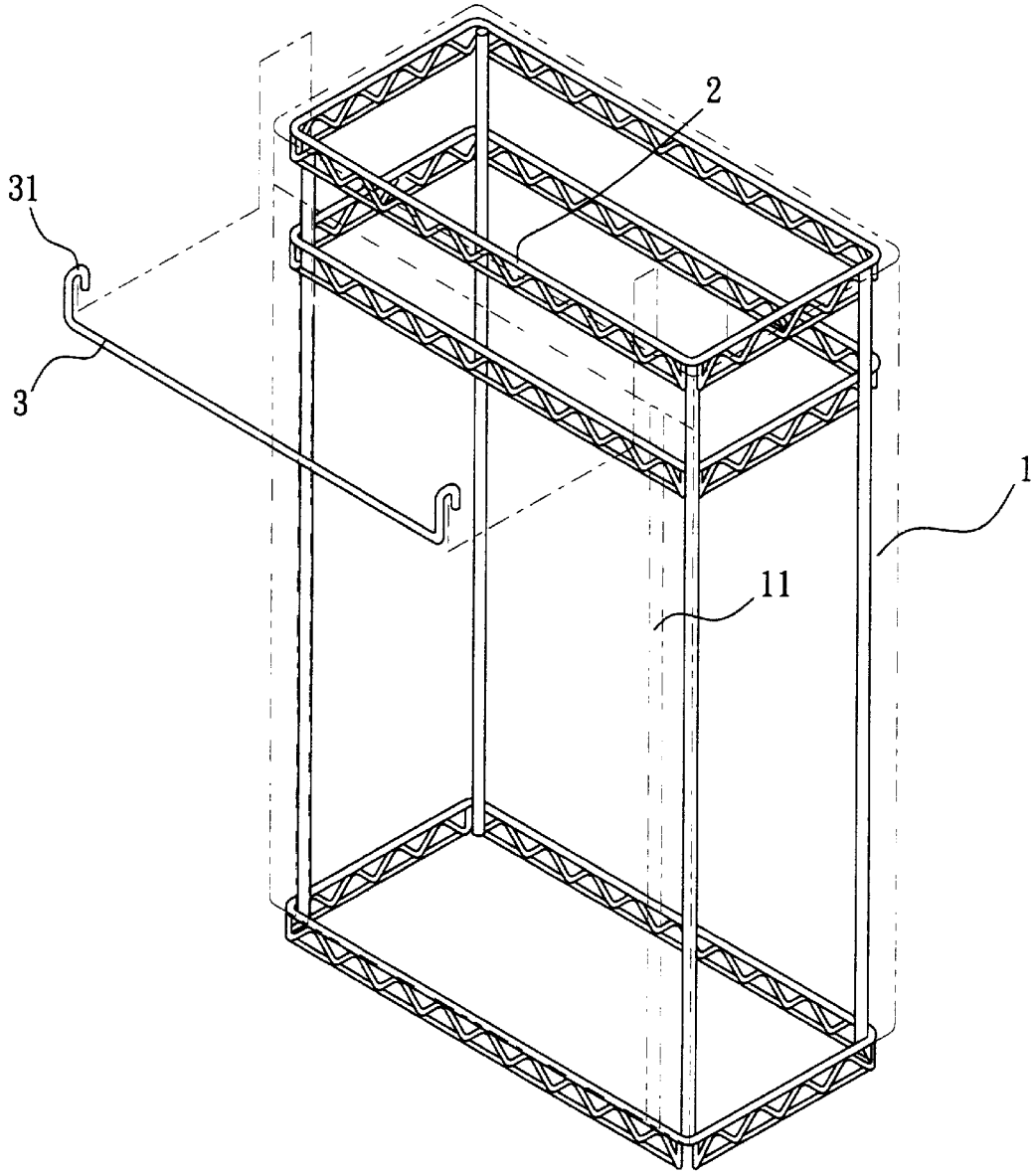
FIG. 1 is a perspective exploded view of a combination wardrobe constructed according to the present invention.

Referring to FIGS. from 1 through 3, a combination wardrobe is shown comprised of a wardrobe body 1, a hanging rod 3, and two flexible door panels 12.

The wardrobe body 1 comprises a frame 2 covered with a plastic covering, and two tapes of loop materials 11 vertically fixedly provided at two sides of the front opening thereof. The hanging rod 3 is metal wire rod. having two hooked end pieces 31 adapted for hooking on the frame 2. The flexible door panels 12 are respectively made of flexible sheet material in a rectangular shape, each having a plurality of loops 121 provided at the top side, a plurality of weights 124 provided at the bottom side, a handle 123 provided at one lateral side, and strips of hook material 122 or 125 provided at the other lateral side.

Figure 2:
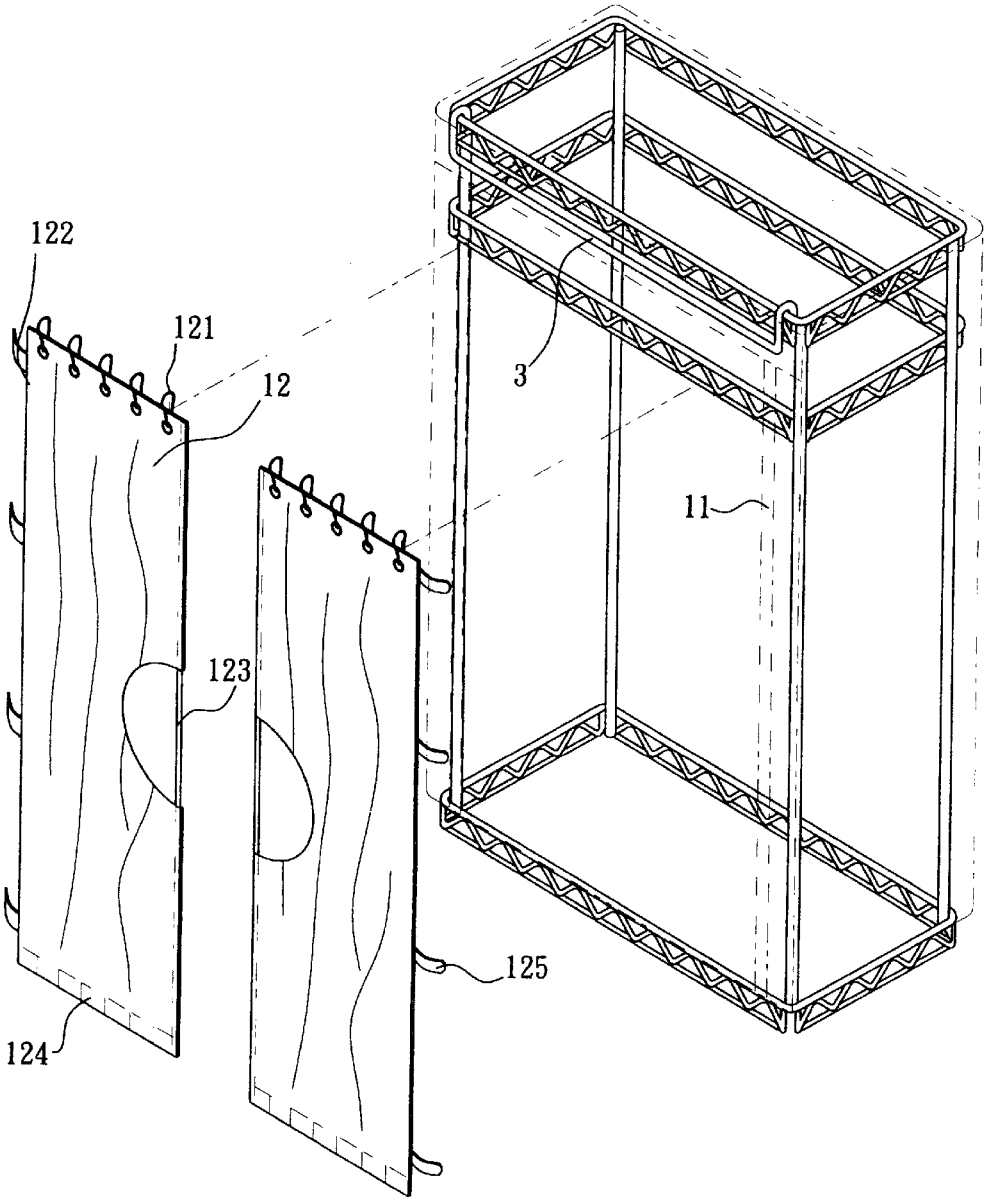
FIG. 2 is another perspective exploded view of the present invention (the door panel excluded).
Figure 3:
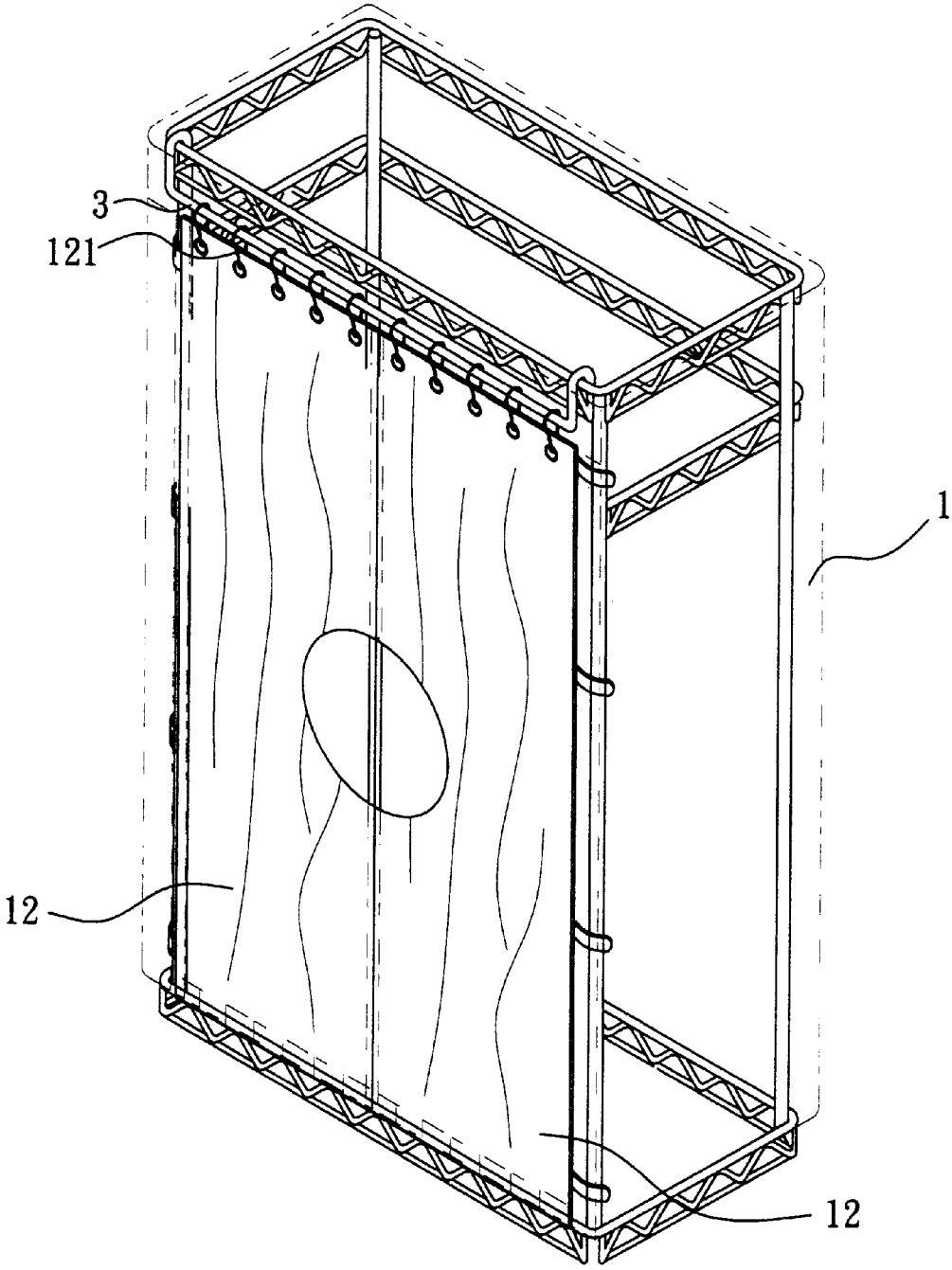
FIG. 3 is a perspective view of the present invention showing the door panels installed.

Referring to FIG. 3 and FIGS. 1 and 2 again, the hanging rod 3 is inserted through the loops 121 of the flexible door panels 12, and then the strips of hook material 122 and 125 of the door panels 12 are respectively fastened to the tapes of loop materials 11 of the wardrobe body 1. When installed, the door panels 12 can be pulled horizontally relative to each other between the close position and the open position. Because weights 124 are fixedly arranged along the bottom side of each door panel 12, the door panels 12 are kept in shape when closed.

Figure 4:
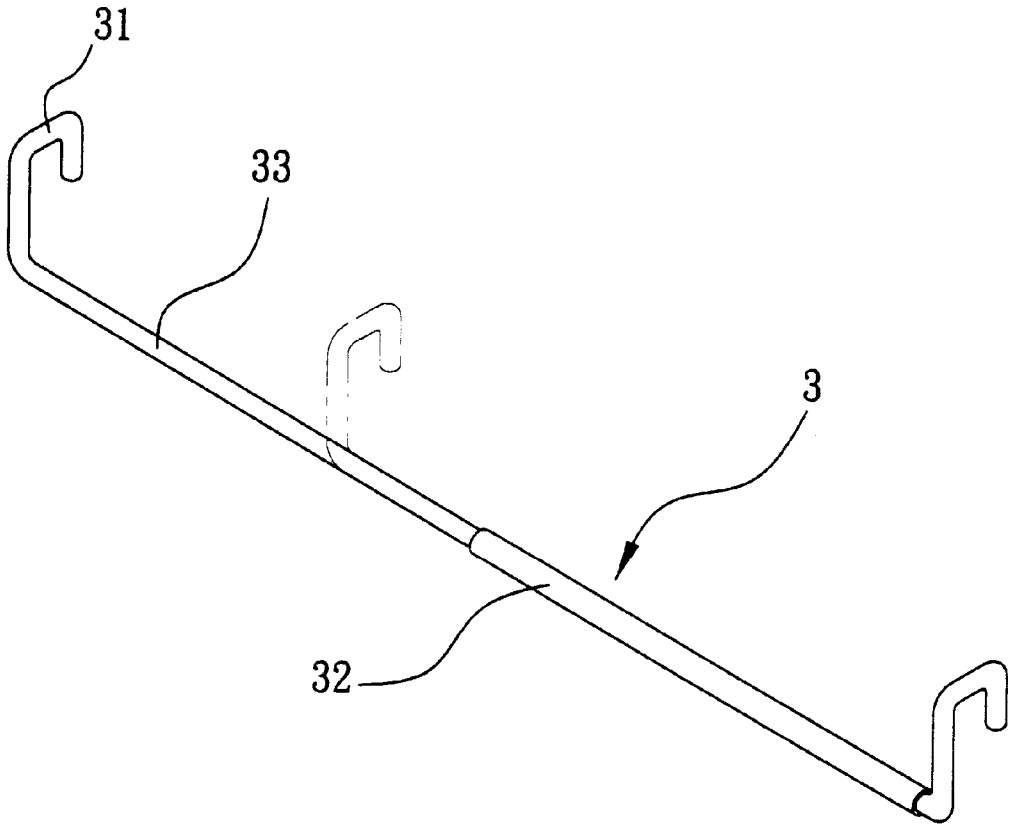
FIG. 4 is an elevational view of an alternate form of the hanging rod according to the present invention.

FIG. 4 shows an alternate form of the hanging rod 3. According to this alternate form, the hanging rod 3 is comprised of two tubular rod members 32 and 33 that slide one inside the other. By means of moving the tubular rod members 32 and 33 relative to each other, the user can adjust the length of the hanging rod 3. After adjustment, the tubular rod members 32 and 33 are rotated relative to each other to lock the hanging rod 3 at the adjusted length. The tubular rod members 32 and 32 each have one end slidably coupled to each other and the other end terminating in a hooked end piece 31 for hooking on the frame 2 of the wardrobe body 1.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A combination wardrobe comprising a wardrobe body having a wardrobe frame defining a front opening and a covering of flexible sheet material covering said wardrobe frame, and a double-panel door structure mounted on said wardrobe frame and moved to close/open the front opening of said wardrobe body, wherein said double-panel door structure comprises a hanging rod transversely suspended from said wardrobe frame at a top side of said front opening, and two flexible door panels respectively hung on said hanging rod and horizontally moved relative to each other to close/open said front opening, said flexible door panels each comprising a top side, a bottom side, a plurality of loops arranged along said top side respectively hung on said hanging rod, and a plurality of weights arranged along said bottom side, said flexible door double-panel door structure further comprising tapes of hook material and tapes of loop materials respectively installed in said wardrobe body at two sides of said front opening and one lateral side of each of said flexible door panels and adapted to secure said flexible door panels to said wardrobe body.

* * * * *